US008510994B2

(12) United States Patent
Scott

(10) Patent No.: US 8,510,994 B2
(45) Date of Patent: Aug. 20, 2013

(54) SECURITY APPARATUS

(76) Inventor: John Scott, Belton, SC (US)

( * ) Notice: Subject to any disclaimer, the term of this patent is extended or adjusted under 35 U.S.C. 154(b) by 80 days.

(21) Appl. No.: 13/024,045

(22) Filed: Feb. 9, 2011

(65) Prior Publication Data

US 2011/0192092 A1 Aug. 11, 2011

Related U.S. Application Data

(60) Provisional application No. 61/302,806, filed on Feb. 9, 2010.

(51) Int. Cl.
*E05B 65/00* (2006.01)
*E05B 65/06* (2006.01)

(52) U.S. Cl.
USPC ..... 49/394; 292/289; 292/291; 292/297; 292/339

(58) Field of Classification Search
USPC ..... 49/394; 292/276, 278, 288, 289, 292/291, 297, 298, 338, 339
See application file for complete search history.

(56) References Cited

U.S. PATENT DOCUMENTS

| | | | | | |
|---|---|---|---|---|---|
| 853,991 | A * | 5/1907 | McKeives | 292/297 |
| 960,521 | A * | 6/1910 | Early | 292/298 |
| 979,167 | A * | 12/1910 | Hutchinson | 292/298 |
| 1,087,750 | A * | 2/1914 | Fealy | 292/297 |
| 1,176,859 | A | 3/1916 | Sautter | |
| 1,178,504 | A * | 4/1916 | Edwards | 292/297 |
| 1,277,819 | A * | 9/1918 | Andrews | 292/297 |
| 1,354,597 | A * | 10/1920 | Cafmeyer | 292/207 |
| 1,406,085 | A * | 2/1922 | Rouch et al. | 292/297 |
| 1,590,133 | A * | 6/1926 | Tennyson | 292/294 |
| 1,598,081 | A * | 8/1926 | Japs | 292/294 |
| 1,671,454 | A * | 5/1928 | Stoutenburgh | 292/293 |
| 1,717,964 | A * | 6/1929 | Dorion | 292/293 |
| 1,833,710 | A * | 11/1931 | Gearhart | 292/291 |
| 1,888,425 | A * | 11/1932 | Dowling | 292/291 |
| 2,128,479 | A * | 8/1938 | Taylor | 292/298 |
| 2,461,398 | A * | 2/1949 | Sands | 292/297 |
| 3,181,319 | A * | 5/1965 | Hudon | 70/14 |
| 3,494,653 | A * | 2/1970 | Steele | 292/291 |
| 3,963,269 | A | 6/1976 | Rosenberg | |
| 4,169,619 | A * | 10/1979 | McCracken | 292/290 |
| 4,311,330 | A * | 1/1982 | Lum | 292/210 |
| 4,382,621 | A * | 5/1983 | Lum | 292/210 |
| 4,383,709 | A | 5/1983 | Ronan | |
| 4,399,672 | A * | 8/1983 | Moorhouse | 70/101 |
| 4,712,816 | A * | 12/1987 | Mueller | 292/253 |
| 4,770,451 | A * | 9/1988 | Souza | 292/289 |
| 5,265,922 | A * | 11/1993 | Falcone | 292/258 |
| 5,291,760 | A * | 3/1994 | Schrader | 70/14 |
| 5,297,829 | A * | 3/1994 | Richardson | 292/289 |
| 5,361,539 | A * | 11/1994 | Widener | 49/394 |
| 5,401,068 | A * | 3/1995 | Barnard | 292/289 |
| 5,623,841 | A * | 4/1997 | Deemar | 70/14 |
| 5,865,484 | A | 2/1999 | Johns | |
| 6,926,316 | B2 * | 8/2005 | Patire et al. | 292/290 |
| 7,360,809 | B1 | 4/2008 | Poston | |

* cited by examiner

*Primary Examiner* — Katherine Mitchell
*Assistant Examiner* — Justin Rephann
(74) *Attorney, Agent, or Firm* — J. Bennett Mullinax, LLC

(57) ABSTRACT

A security apparatus may include a portion that engages a wall on one side of a doorway, a portion that extends through the doorway, and another portion that may engage the door on the opposite side of the doorway. In operation, the apparatus may function to transmit a force applied to the front of the door to the exterior wall to reinforce the door against an unauthorized entry (e.g., an intruder kicking the door).

8 Claims, 3 Drawing Sheets

SECURITY APPARATUS

CROSS-REFERENCE TO RELATED APPLICATIONS

This application claims priority from U.S. Provisional Application Ser. No. 61/302,806, filed Feb. 9, 2010, the disclosure of which is incorporated by reference herein in its entirety.

FIELD OF THE INVENTION

An apparatus is disclosed for securing a door against unauthorized entry.

REFERENCE TO RELATED ART

The field of door security has continued to innovate since the development of the wooden door bar. Deadbolt locks are now common in the home. Door catches have also been developed, such as the catch disclosed by Sautter in U.S. Pat. No. 1,176,869. A more elaborate structure was a two part security device disclosed by U.S. Pat. No. 3,963,269. There are also kick-in resistant door reinforcing assemblies, such as the device disclosed by U.S. Pat. No. 7,360,809. However, all these devices may be difficult, or require special tools, to install, or have a design that provides little if any additional security over a common deadbolt. In addition, while many devices may "lock" a door, far fewer have any ability to mitigate or stop a forced or "kick-in" style entry. Therefore, room exists for advancement in the art.

SUMMARY OF THE INVENTION

An apparatus is disclosed for securing a door against unauthorized entry. The apparatus may include a plate, a brace and a fastener.

The plate may be positioned along a jam of a door frame so that the plate extends through the doorway. The plate may have a catch at one end and define, proximate an opposite end, a first aperture that extends through the body of the plate. The catch may extend substantially perpendicular to one side of the plate and function to engage one side of an exterior wall (or similar support surface) when the plate is positioned in the doorway.

The brace of the apparatus, which may be L-shaped, may include a first section and a second section. The first section may be pivotably mounted to the opposite end of the plate (the end nearest the aperture of the plate) and include a second aperture that extends through the first section.

In operation, the brace may pivot about the end of the plate so that it is placed into an orientation in which the first section is parallel to an opposite side of the plate and the second portion of the brace functions to engage an interior surface of a door. When in this orientation, the aperture of the brace may also be coaxially aligned with the aperture of the plate. As a result, the fastener may be extended through or otherwise function with the apertures to secure the brace in position. In addition, when in this orientation, the apparatus may function to transmit a force applied to the front of the door to the exterior support surface/wall to thereby reinforce the door against an unauthorized entry (e.g., an intruder kicking the door).

BRIEF DESCRIPTION OF THE DRAWINGS

Reference will be made below to the associated figure wherein like reference numerals refer to like parts throughout and wherein.

DETAILED DESCRIPTION OF THE INVENTION

An embodiment of a security apparatus may include a portion that engages a wall on one side of a doorway, a portion that extends through the doorway, and another portion that may engage the door on the opposite side of the doorway. Thus, when viewed (for example) from the perspective of a front door of a residential home, the apparatus may have a portion that engages the exterior wall of the home proximate the doorway, a portion that extends through the doorway into the interior of the home, and another portion that may engage the interior or back side of the front door. In operation, the apparatus may function to transmit a force applied to the front of the door to the exterior wall to reinforce the door against an unauthorized entry (e.g., an intruder kicking the door). By transmitting the force to the exterior wall rather than then, for example, a door jam or frame, the apparatus provides improved resistance against forced entry.

Figure 1:
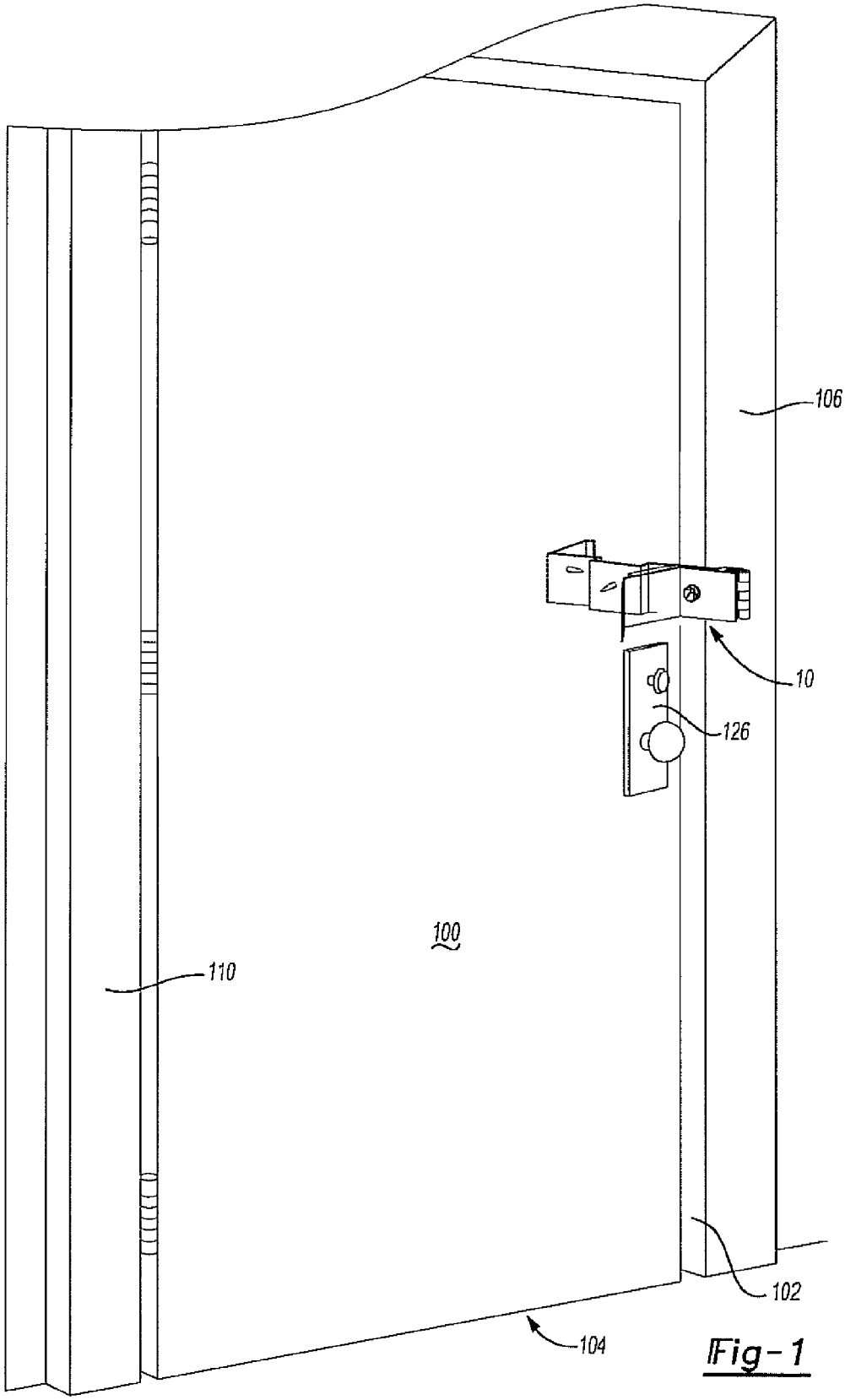
FIG. 1 is an environmental perspective view of an embodiment of a security apparatus positioned in a doorway.
Figure 2:
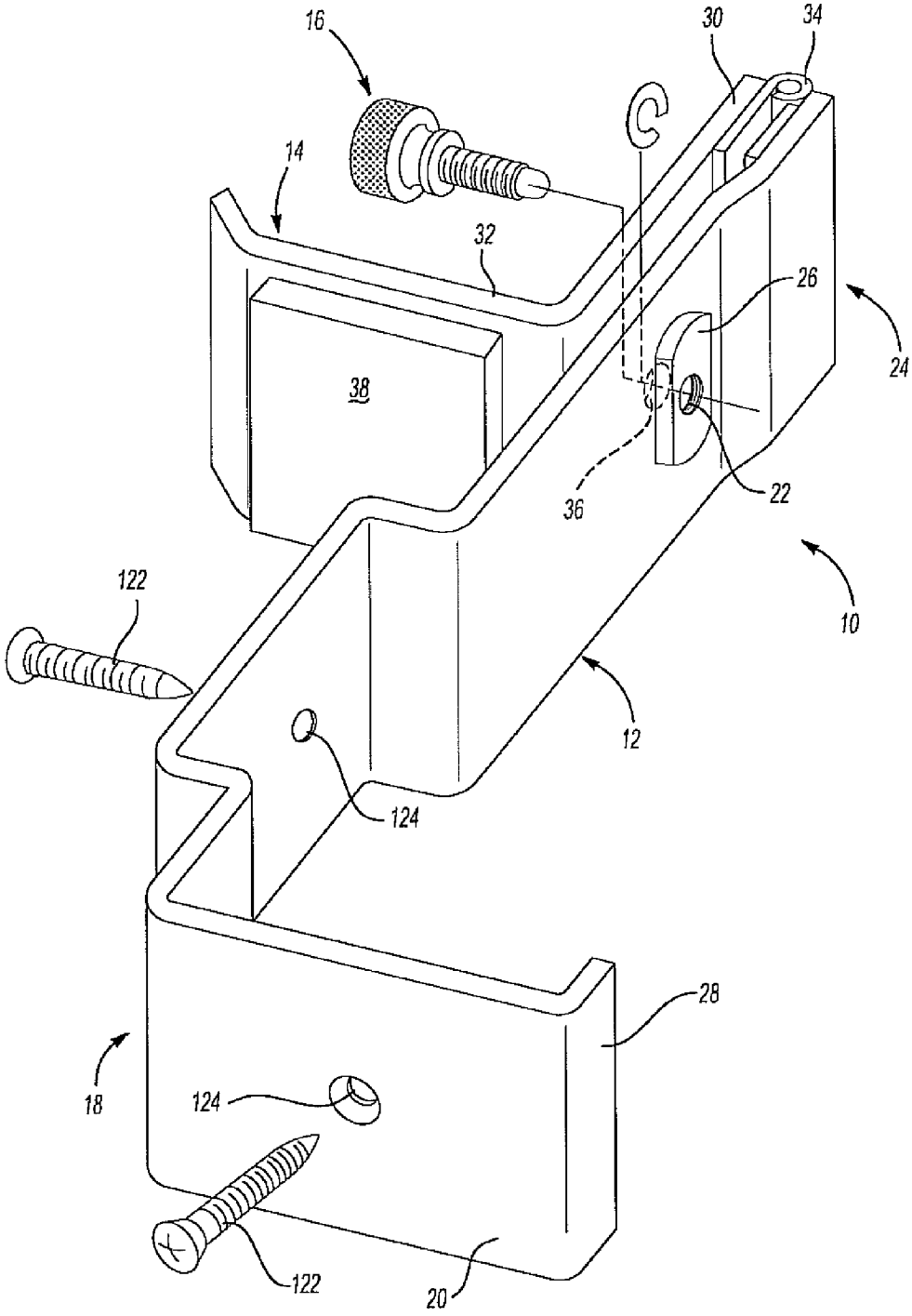
FIG. 2 is a top perspective view of the embodiment of the security apparatus shown in FIG. 1.
Figure 3:
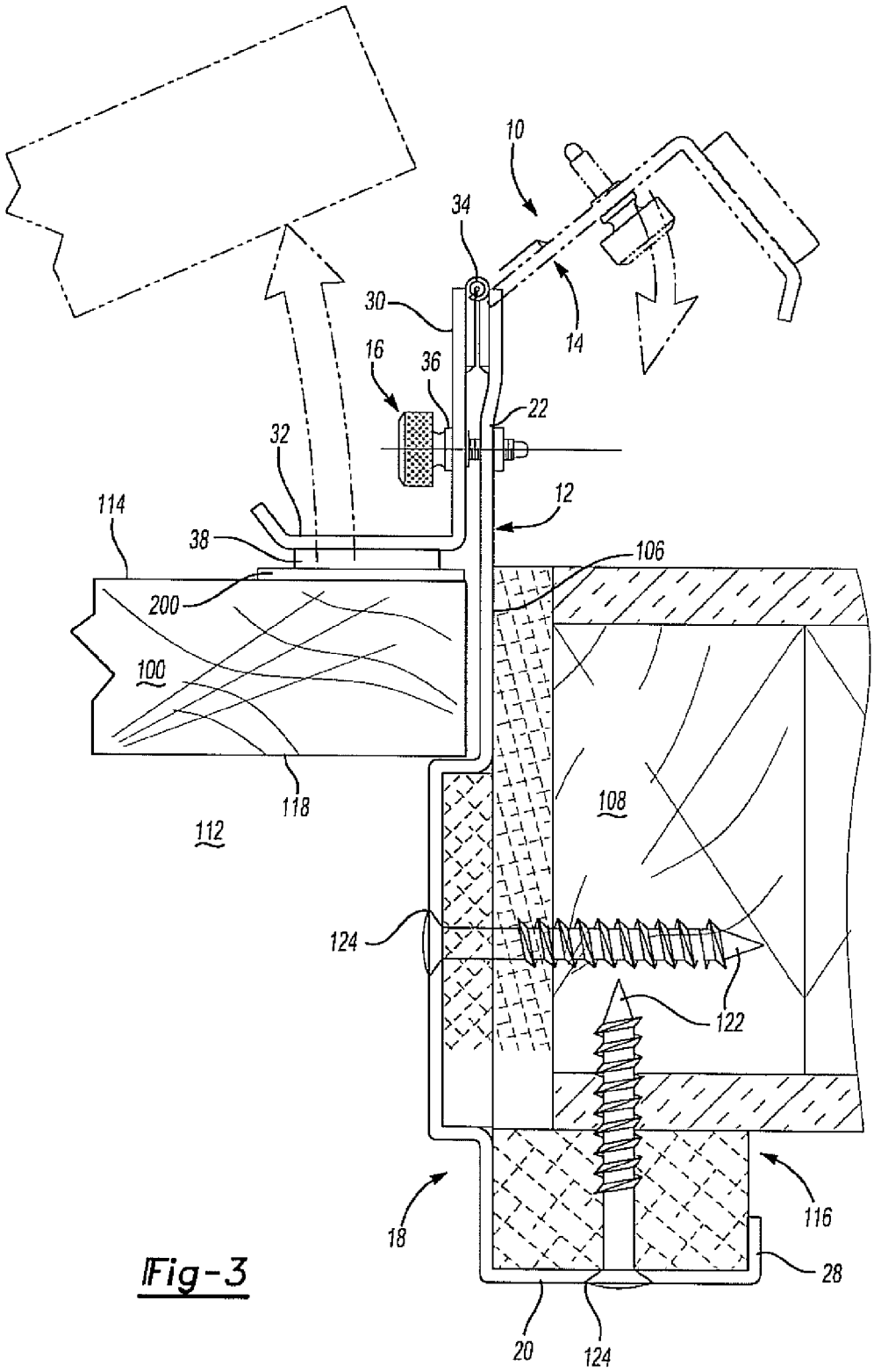
FIG. 3 is a side, planar, cut-away view of the embodiment of the security apparatus shown in FIG. 1 positioned in a doorway.

Referring now to FIGS. 1-3, an apparatus 10 for securing a door 100 against unauthorized entry may include an elongated bar or plate 12, a bracket or brace 14, and one or more fasteners 16. The apparatus 10 may be configured or dimensioned so that it may be positioned along a perimeter surface 102 of a doorway 104. More specifically, the apparatus 10 may be positioned on and substantially perpendicular to a jam 106 (preferably the jam 106 bearing the strike plate (not shown)) of a door frame 108 (with the opposing jam 110 being used to hang the door 100 as is common). The plate 12 may have a length sufficient for it to extend from an exterior or one side 112 of the doorway 104 into an interior or other side 114 of the doorway 104. The plate 12 may also include at one end 18 a flange or catch 20. The catch 20 of the plate 12 may engage a support surface 116 (e.g., the wall, molding, etc.) on the one side 112 of the doorway 104. Then, as shown, the brace 14 may engage an interior surface 114 of the door 100 and be secured to the plate 12 by the fastener(s) 16. As a result, a force applied to an exterior surface 118 of the door 100 will be transmitted at least in part through the apparatus 10 and to the support surface 116.

Still referring to FIGS. 1-3, the apparatus 10 may be constructed of treated annealed steel. However, other materials such as titanium, metal alloys, carbon fiber, and synthetic materials may also be used to construct the apparatus 10 or any of its parts. The apparatus 10 may also be constructed from precast materials and then shaped or assembled as necessary.

Still referring to FIGS. 1-3, the plate 12 may have a length between 2 and 24 inches. However, it will be appreciated that for many applications the length of the plate 12 can be between 5 and 9 inches. In addition, for certain applications, the length might be 36 inches or longer. The width of the plate 12 may be between 1 and 4 inches, and it may have a height of between 1/16 and 1/2 inch, with more preferred height ranges being 1/16 to 1/8 inches and 1/8 to 1/4 inches. As best shown in FIG. 3, the elongated plate 12 may also include a predetermined shape(s) or contour(s) along its length so that it may closely fit the perimeter surface 102 of the doorway 104. An aperture 22 may be defined through the plate 12 proximate an end 24 of the plate 12 opposite the brace 14. As will be described further below, the aperture 22 may be threaded, be reinforced and/or lengthened with additional material 26, and operate to receive the fastener 16.

Still referring to FIGS. 1-3, the catch 20 of the plate 12 may be formed as a unitary part of the plate 12, but it may also alternatively be formed as a separate element and then fixed (or optionally removably secured) to the plate 12. As shown, the catch 20 may extend substantially perpendicular to a longitudinal axis of the plate 12 so that the catch 20 may engage the exterior of a structural support surface 116 such as an exterior wall, or the molding on the exterior or one side 112 of the doorway 104. Moreover, where the support surface 116 includes architectural details, such as molding or like surface structure, the catch 20 may include one or more flange(s) 28 to assist in securing or bracketing the plate 12 and the catch 20 to or around molding.

Still referring to FIGS. 1-3, the brace 14 of the apparatus 10 may be positioned on the plate 12 and oriented so that the brace 14 may engage the interior surface 114 of the door 100. For example, as shown, the brace 14 may include an L-shaped bracket that includes a first section or portion 30 and a second portion or section 32. The first portion 30 may be secured by a hinge 34 to the end 24 of the plate 12 opposite the catch 20. An aperture 36 may be defined through the second portion 36. The aperture 36 may be threaded and function to receive the fastener 16 of the apparatus 10. It will be appreciated, however, that the brace 14 may include a variety of configurations, and may be fixed (or removably positioned) on the elongated plate at a variety of locations.

Still referring to FIGS. 1-3, the fastener 16 may include an unthreaded fastener or a threaded fastener such as a screw, carriage bolt or the like, having a predetermined length. In addition, the aperture 22 of the plate 12 and the aperture 36 of the second portion 24 may be configured to be substantially coaxially aligned when the brace 14 is oriented so that the second portion 24 engage an interior surface 114 of the door 100. As shown in FIG. 1, a face of the fastener may include a slot for receiving a screwdriver, coin or the like to assist in releasing/unscrewing the fastener 16. Moreover, as best shown in FIG. 2, a washer or the like may be used to retain the fastener 16 in the aperture 22.

In operation, the brace 14 of the embodiment of the apparatus 10 shown in FIGS. 1-3 may mounted to a door frame 108 using one or more fasteners (screws) 122 extending through one or more apertures 124 defined through the plate 12 and/or catch 20. be selectively pivoted about the hinge 34 into an orientation where the second portion 32 of the brace 14 may engage the interior surface 114 of the door 100. To that end, the second portion 24 of the brace 14 may feature a pad or cushion 38 that directly contacts the door 100 to guard against damage or scratching of the door 100. A metal plate 200 may also be mounted to the interior surface 114 of the door 100 and be positioned so that it may be engaged by the second portion 24 of the brace 14. The plate 200 provides still further security against forced entry and, when positioned proximate a door latch 126, it adds a further metal reinforcement surface behind that latch 124. The fastener 16 may then be extended through the aperture 36 of the brace 14 and engage the aperture 22 of the plate 12 to thereby secure the brace 14 to the plate 12. Securing the brace 14 to the plate 12 in this manner maintains the brace 14 in position relative to the plate 12 during use of the apparatus 10. It has also been found to strengthen the apparatus 10 during use by preventing/mitigating sheering between the brace 14 and plate 12 at the hinge 34 as a result of a force being applied to the door 100.

While the apparatus 10 is generally described herein as being used for an exterior door 100, it will be appreciated that it may also be used with an interior door 100. As such, the apparatus 10 may be used to provide protection for persons concerned about their safety when staying in strange homes, guest rooms or the like.

Having thus described an embodiment of the apparatus, various other embodiments will become apparent to those of skill in the art that do not depart from the scope of the claims.

The invention claimed is:

1. A secure door assembly comprising:

a door assembly positioned in a wall and including a door frame and a door, the door frame defining a doorway and including a first and a second vertically extending spaced apart door jamb, and the door being hingedly mounted to the first door jam and operating to be opened in a first direction; and a security device including a plate, a brace and a fastener, the plate being positioned along one of said jams and extending completely through side of the doorway, and the plate including a first side, a second side, having a catch at one end, and defining proximate an opposite end a first aperture that extends through the plate, the catch extending substantially perpendicular to the first side of the plate and engaging one side of the wall, the brace having a first section and a second section, the first section being pivotably mounted to the opposite end of the plate and defining a second aperture that extends through the first section, the brace being pivotable about the opposite end of the plate into a first orientation so that the first section is parallel to the second side of the plate, the first aperture is coaxially aligned with the second aperture, and the second section engages a side of the door on the other side of the wall, and the fastener extending though the first and second aperture to removably secure the brace in the first orientation.

2. The assembly of claim 1, wherein the plate is positioned along the second door jam.

3. The apparatus of claim 1, wherein the second section of the brace extends substantially perpendicular to the first section.

4. The apparatus of claim 3, wherein the brace comprises an L-shaped member.

5. The apparatus of claim 1, wherein the second section of the brace comprises a pad.

6. The apparatus of claim 1, wherein the fastener comprises a threaded fastener.

7. The apparatus of claim 1, wherein the brace is pivotably mounted to the opposite end of the plate by a hinge.

8. The apparatus of claim 1, wherein the plate is a longitudinally extending plate and the catch extends substantially perpendicular to a longitudinal axis of the plate.

* * * * *